US009908331B2

(12) United States Patent
Hirai et al.

(10) Patent No.: US 9,908,331 B2
(45) Date of Patent: Mar. 6, 2018

(54) MEMS DEVICE AND LIQUID EJECTING HEAD

(71) Applicant: SEIKO EPSON CORPORATION, Tokyo (JP)

(72) Inventors: Eiju Hirai, Azumino (JP); Motoki Takabe, Shiojiri (JP); Katsutomo Tsukahara, Shiojiri (JP); Yoichi Naganuma, Matsumoto (JP); Munehide Saimen, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/418,987

(22) Filed: Jan. 30, 2017

(65) Prior Publication Data

US 2017/0217175 A1 Aug. 3, 2017

(30) Foreign Application Priority Data

Feb. 1, 2016 (JP) ..... 2016-016933

(51) Int. Cl.

| | |
|---|---|
| ***B41J 2/14*** | (2006.01) |
| ***B41J 2/045*** | (2006.01) |
| ***B41J 2/175*** | (2006.01) |
| ***B41J 2/19*** | (2006.01) |

(52) U.S. Cl.

CPC ..... *B41J 2/14201* (2013.01); *B41J 2/04548* (2013.01); *B41J 2/04581* (2013.01); *B41J 2/14233* (2013.01); *B41J 2/17596* (2013.01); *B41J 2/19* (2013.01); *B41J 2/14072* (2013.01); *B41J 2002/14241* (2013.01); *B41J 2002/14491* (2013.01); *B41J 2202/07* (2013.01); *B41J 2202/18* (2013.01)

(58) Field of Classification Search

CPC ..... B41J 2/14201; B41J 2/04548; B41J 2/04581; B41J 2/14233; B41J 2/14072; B41J 2002/14491

See application file for complete search history.

(56) References Cited

U.S. PATENT DOCUMENTS

| | | | | |
|---|---|---|---|---|
| 2008/0030548 | A1 | 2/2008 | Kubo | |
| 2012/0242751 | A1* | 9/2012 | Shimizu | B41J 2/14209 347/50 |
| 2013/0342610 | A1 | 12/2013 | Lee et al. | |

FOREIGN PATENT DOCUMENTS

| | | | |
|---|---|---|---|
| EP | 1245390 | | 10/2002 |
| JP | 2007-196544 | A | 8/2007 |
| JP | 2009-225032 | A | 10/2009 |
| WO | 2014003768 | | 1/2014 |

OTHER PUBLICATIONS

European Search Report issued in Application No. 17154051 dated Jul. 28, 2017.

* cited by examiner

*Primary Examiner* — Geoffrey Mruk
(74) *Attorney, Agent, or Firm* — Workman Nydegger

(57) ABSTRACT

A MEMS device includes a plurality of movable regions, wiring lines extending along a first direction from the movable regions, and electrodes connected to the wiring lines. The electrodes include connection regions for connecting other electrode terminals to the connection regions. A plurality of the connection regions are disposed along a second direction intersecting the first direction. A distance between centers of connection regions that are adjacent in the second direction is longer than a distance between centers of movable regions that are adjacent in the second direction.

10 Claims, 6 Drawing Sheets

MEMS DEVICE AND LIQUID EJECTING HEAD

CROSS-REFERENCE TO RELATED APPLICATIONS

The present application claims priority to Japanese Patent Application No. 2016-016933, filed Feb. 1, 2016, which is hereby incorporated by reference in its entirety.

BACKGROUND

1. Technical Field

The present invention relates to a MEMS device used to eject liquid or the like and a liquid ejecting head, and in particular, relates to a MEMS device provided with plural movable regions and electrodes corresponding to the movable regions, and a liquid ejecting head.

2. Related Art

Microelectromechanical systems (MEMS) devices including plural movable regions have applications in a variety of apparatuses (for example, liquid ejecting apparatus, sensors, and the like). For example, a liquid ejecting head, this being one type of MEMS device, is provided with pressure chambers that have a portion bounded by the movable regions described above, piezoelectric elements that displace the movable regions, nozzles that are in communication with the pressure chambers, and the like. An image recording apparatus such as an ink jet printer or an ink jet plotter is an example of a liquid ejecting apparatus mounted with such a liquid ejecting head. Recently, liquid ejecting heads have found applications in various types of manufacturing apparatuses that utilize the ability to accurately land minute amounts of liquid at specific positions. For example, liquid ejecting heads have applications in display manufacturing apparatuses that manufacture color filters for liquid crystal displays or the like, electrode forming apparatuses that form electrodes for organic electroluminescent (EL) displays, field emission displays (FEDs), and the like, and chip manufacturing apparatuses that manufacture biochips (biochemical elements). In the recording heads of image recording apparatuses, liquid ink is ejected. In colorant ejecting heads for display manufacturing apparatuses, solutions of R (red), G (green), and B (blue) colors are each ejected as respective types of liquid. In electrode material ejecting heads for electrode forming apparatuses, a liquid electrode material is ejected as one type of liquid, and in bioorganic matter ejecting heads for chip manufacturing apparatuses, a bioorganic matter solution is ejected as one type of liquid.

In the liquid ejecting heads described above, the piezoelectric elements are driven by voltages (electrical signals) applied to the piezoelectric elements, and configuration is such that pressure fluctuations in the liquid inside the pressure chambers arise so as to eject liquid from the nozzles. Here, wiring that is used to apply voltages to the piezoelectric elements is laid out from the piezoelectric elements toward the outside of the movable regions, and the wiring is connected to a wiring substrate through electrodes. Such electrodes provided in a row along the array direction of the piezoelectric elements (namely, the pressure chambers) with a pitch that is the same as the array pitch of the piezoelectric elements. As described in JP-A-2009-056662, a configuration is adopted in which the electrodes are arrayed above the pressure chambers in the same arrangement as the arrangement of the pressure chambers.

Accompanying an increase in nozzle density, there is a trend to reduce the array pitch of electrodes similarly to the array pitch of the piezoelectric elements. Namely, there is a trend to move electrodes corresponding to adjacent piezoelectric elements closer together. As electrodes move closer together, there is a tendency for shorting to occur between electrodes resulting from electrical discharge, migration, or the like between the electrodes. When such faults occur between electrodes, liquid is not ejected from the nozzles as expected, and the reliability of the liquid ejecting head is decreased.

SUMMARY

An advantage of some aspects of the invention is that a MEMS device and a liquid ejecting head can have high reliability.

A MEMS device according to an aspect of the invention includes plural movable regions, wiring lines extending along a first direction from the movable regions, and electrodes connected to the wiring lines. The electrodes include connection regions for connecting other electrode terminals to the connection regions. Plural of the connection regions are disposed along a second direction intersecting the first direction, and a distance between centers of ones of the connection regions that are adjacent in the second direction is longer than a distance between centers of ones of the movable regions that are adjacent in the second direction.

According to this configuration, shorting between electrodes arising from electrical discharge, migration, or the like between the electrodes is suppressed, even when the array pitch of piezoelectric elements (namely, the distance between centers of piezoelectric elements) has been reduced in order to dispose the nozzles at a high density. As a result, the reliability of the liquid ejecting head is improved.

In the above configuration, it is preferable to provide plural connection region rows, respectively configured from the connection regions having positions aligned in the second direction, at differing positions in the first direction.

According to this configuration, the arrangement of the electrodes can be simplified.

Moreover, in the above configuration, it is preferable that the movable regions, the wiring lines, and the electrodes are provided to a first substrate, and that an insulator sandwiched between the first substrate and a second substrate provided with the other electrode terminals is formed between ones of the connection region rows that are adjacent in the first direction on the first substrate.

According to this configuration, shorting between electrodes resulting from electrical discharge, migration, or the like between the electrodes is suppressed between the connection region rows.

Moreover, in the above configuration, it is preferable that the contact region where the wiring lines and the electrodes are connected together is covered by the insulator.

According to this configuration, shorting between electrodes resulting from electrical discharge, migration, or the like between the electrodes is suppressed in the contact region.

In the above configuration, it is preferable that the distance between centers of ones of the connection regions that are adjacent in the second direction is at least twice the distance between centers of ones of the movable regions that are adjacent in the second direction.

According to this configuration, shorting between electrodes resulting from electrical discharge, migration, or the like between the electrodes is further suppressed.

A liquid ejecting head includes a MEMS device configured as above. The MEMS device includes pressure chambers that have at least a portion bounded by the movable regions, piezoelectric elements that displace the movable regions, and nozzles that are in communication with the pressure chambers. The electrodes are individual terminals that transmit a drive signal to the piezoelectric elements through the wiring lines.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
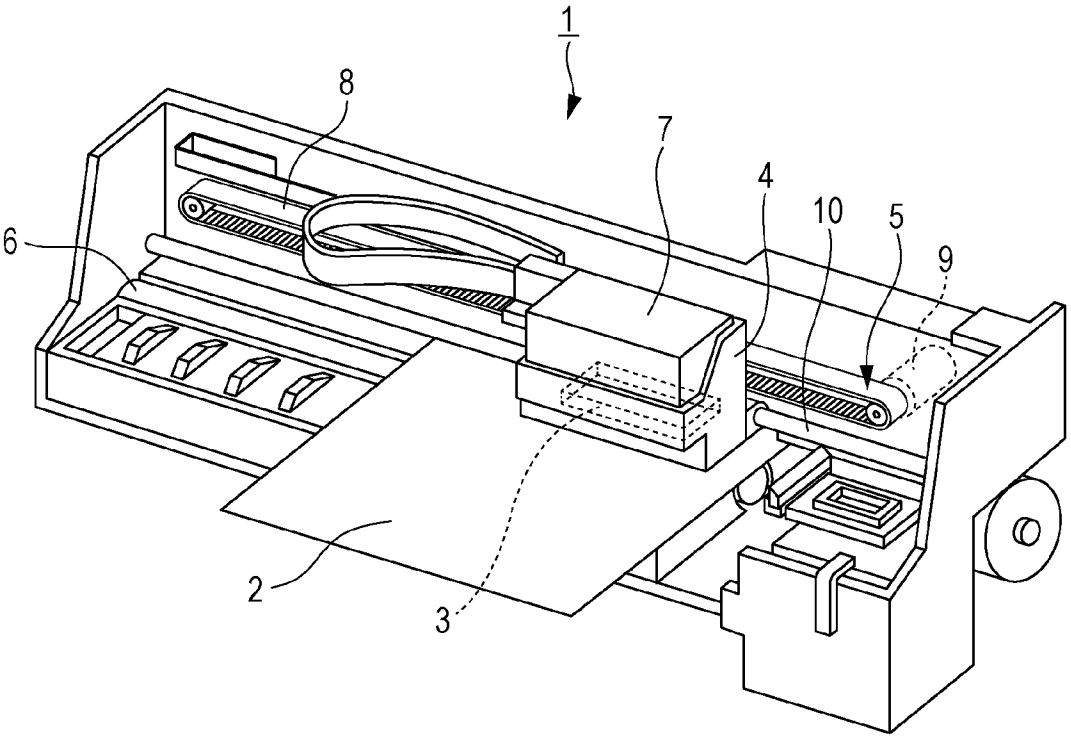
FIG. 1 is a perspective view illustrating configuration of a printer.

Explanation follows regarding embodiments of the invention, with reference to the accompanying drawings. The embodiments described below include various limitations as preferable specific examples of the invention. However, the scope of the invention is not limited thereby unless specifically indicated to be so in the following explanation. Moreover, in the following, explanation is given using the example of a liquid ejecting head, this being one category of MEMS device, and in particular, an ink jet recording head (hereinafter, recording head) 3, this being one type of liquid ejecting head. FIG. 1 is a perspective view of an ink jet printer (hereinafter, printer) 1, this being one type of liquid ejecting apparatus mounted with a recording head 3.

Printer 1 is an apparatus that ejects ink (one type of liquid) onto the surface of a recording medium 2 such as recording paper (one type of landing target) to record images or the like. The printer 1 includes a recording head 3, a carriage 4 to which the recording head 3 is attached, a carriage moving mechanism 5 that moves the carriage 4 along a primary scanning direction, a transport mechanism 6 that moves the recording medium 2 along a secondary scanning direction, and the like. The ink is stored in an ink cartridge 7 that serves as a liquid supply source. The ink cartridge 7 is detachably mounted to the recording head 3. Note that configuration may be made in which the ink cartridge is disposed on a main body side of the printer, and ink is supplied from the ink cartridge to the recording head through ink supply tubing.

The carriage moving mechanism 5 includes a timing belt 8. The timing belt 8 is driven by a pulse motor 9 such as a DC motor. Accordingly, when the pulse motor 9 is actuated, the carriage 4 is guided along a guide rod 10 spanning across the printer 1, and moves back and forth along the primary scanning direction (a width direction of the recording medium 2). The position of the carriage 4 in the primary scanning direction is detected by a linear encoder (not illustrated in the drawings), this being one type of position information detector, and obtained by a controller of the printer 1. The linear encoder transmits detection signals, namely, encoder pulses (one type of position information), to the controller of the printer 1.

Figure 2:
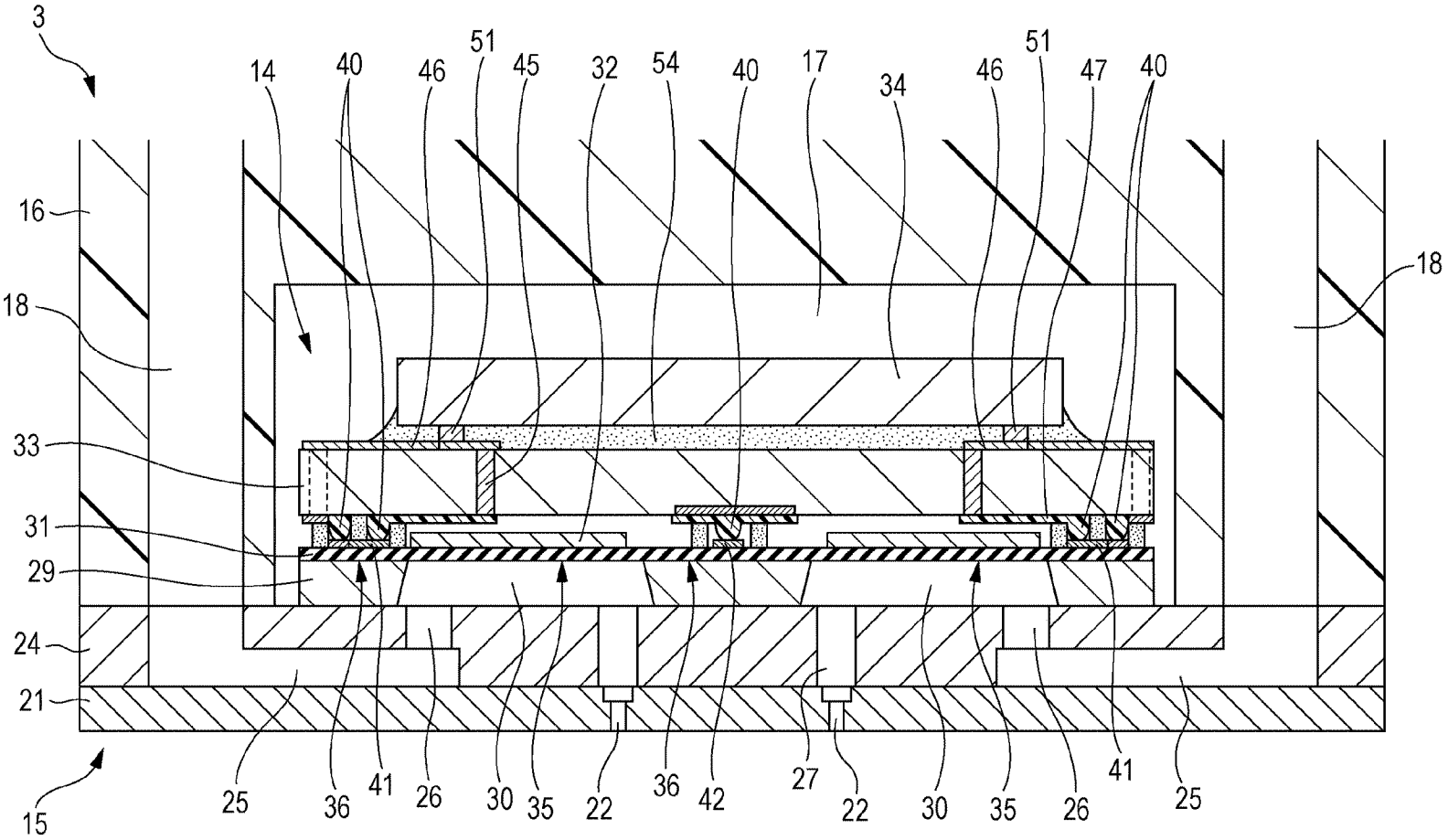
FIG. 2 is a cross-section illustrating configuration of a recording head.
Figure 3:
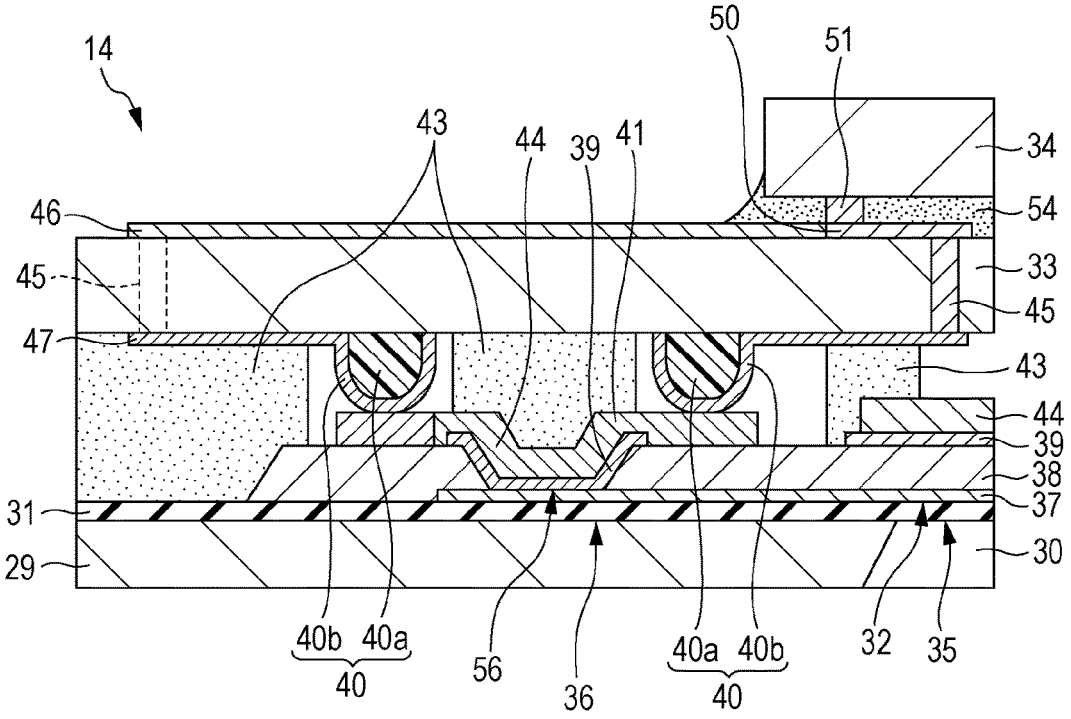
FIG. 3 is an enlarged cross-section of portions of a recording head.

Next, explanation is given regarding the recording head 3. FIG. 2 is a cross-section illustrating configuration of the recording head 3. FIG. 3 is an enlarged cross-section of portions of the recording head 3. Note that for convenience, the stacking direction of the various members configuring an actuator unit 14 is described as the up-down direction. As illustrated in FIG. 2, the recording head 3 of the present embodiment is attached to a head case 16 in a state in which the actuator unit 14 and a flow path unit 15 are stacked.

The head case 16 is a box shaped member made from synthetic resin, and liquid entry paths 18 that supply ink to respective pressure chambers 30 are formed inside the head case 16. The liquid entry paths 18, together with common liquid chambers 25, described below, respectively configure spaces where ink common to the plural pressure chambers 30 is stored. In the present embodiment, two of the liquid entry paths 18 are formed so as to correspond to the rows of the pressure chambers 30, which are provided in two rows. A housing space 17 is formed at the lower face side of the head case 16. The housing space 17 has a cuboid shape hollowed out from a lower face of the head case 16 to partway along a height direction of the head case 16. When the flow path unit 15, described below, is bonded to the head case 16 in a state positioned at the lower face thereof, the actuator unit 14 (pressure chamber formation substrate 29, sealing plate 33, driving IC 34, and the like), which is stacked on a communication substrate 24, is configured so as to be housed inside the housing space 17.

The flow path unit 15 bonded to the lower face of the head case 16 includes the communication substrate 24 and a nozzle plate 21. The communication substrate 24 is a substrate made of silicon (for example, a monocrystalline silicon substrate) that configures an upper portion of the flow path unit 15. As illustrated in FIG. 2, the common liquid chambers 25 that are in communication with the liquid entry paths 18 and that store ink common to the pressure chambers 30, individual communication paths 26 that individually supply ink from the liquid entry paths 18 to the pressure chambers 30 through the common liquid chambers 25, and nozzle communication paths 27 that place the pressure chambers 30 and nozzles 22 in communication with each other, are formed in the communication substrate 24 by anisotropic etching. The common liquid chambers 25 are spaces elongated in the nozzle row direction (corresponding to a second direction of the invention), and are formed in two rows so as to correspond to the rows of the pressure chambers 30, which are provided in two rows.

The nozzle plate 21 is a substrate made of silicon (for example, a monocrystalline silicon substrate) that is bonded to a lower face of the communication substrate 24 (the face on the opposite side to the pressure chamber formation substrate 29). In the present embodiment, openings at the lower face side of the spaces forming the common liquid chambers 25 are sealed off by the nozzle plate 21. Plural of the nozzles 22 are also opened in straight lines shapes (a row pattern) in the nozzle plate 21. In the present embodiment, nozzle rows are formed in two rows so as to correspond to the rows of the pressure chambers 30, which are formed in two rows. The plural nozzles 22 provided in rows (nozzle rows) are provided at uniform intervals along the secondary scanning direction orthogonal to the primary scanning direction from one end side of the nozzles 22 to another end side of the nozzles 22 with a pitch corresponding to a dot formation density. Note that the nozzle plate can be bonded to a region away from the common liquid chambers, at the inside of the communication substrate, and openings at the lower face side of the spaces forming the common liquid chambers can be sealed off by a member such as a flexible compliance sheet. Such a configuration enables the nozzle plate to be as small as possible.

As illustrated in FIG. 2 and FIG. 3, the pressure chamber formation substrate 29, a diaphragm 31, piezoelectric elements 32, the sealing plate 33, and the driving IC 34 of the actuator unit 14 of the present embodiment are stacked so as to form a single unit. Note that the actuator unit 14 is formed smaller than the housing space 17 such that the housing space 17 is capable of housing the actuator unit 14.

The pressure chamber formation substrate 29 is a hard plate member made from silicon, and in the present embodiment, is manufactured from a monocrystalline silicon substrate with surfaces (an upper face and a lower face) having the crystal plane orientation of that of a (110) plane. The pressure chamber formation substrate 29 is anisotropic etched to completely remove portions of the pressure chamber formation substrate 29 in the plate thickness direction so as to provide plural spaces for forming the pressure chambers 30 in a row along the nozzle row direction. These spaces are bounded from below by the communication substrate 24, and bounded from above by the diaphragm 31, thereby configuring the pressure chambers 30. The spaces, namely, the pressure chambers 30, are formed in two rows so as to correspond to the nozzle rows, which are formed in two rows. The pressure chambers 30 are spaces elongated in a direction orthogonal to the nozzle row direction (corresponding to a first direction of the invention). End portions on one length direction side of the respective pressure chambers 30 are in communication with the individual communication paths 26, and end portions on the other length direction side of the respective pressure chambers 30 are in communication with the nozzle communication paths 27.

The diaphragm 31 is a thin film member with elastic properties, and is stacked on an upper face of the pressure chamber formation substrate 29 (the face on the opposite side to the communication substrate 24 side). The diaphragm 31 seals off upper openings of the spaces for forming the pressure chambers 30. In other words, the pressure chambers 30 are bounded by the diaphragm 31. Portions of the diaphragm 31 corresponding to the pressure chambers 30 (specifically, the upper openings of the pressure chambers 30) function as displacement portions that are displaced in a direction moving away from, or in a direction approaching, the nozzles 22 accompanying flexural deformation of the piezoelectric elements 32. Namely, regions of the diaphragm 31 corresponding to the upper openings of the pressure chambers 30 configure driving regions 35 where flexural deformation is permitted (corresponding to movable regions of the invention). Regions of the diaphragm 31 away from the upper openings of the pressure chambers 30 configure non-driving regions 36 where flexural deformation is impeded.

Note that the diaphragm 31 is, for example, configured from an elastic film composed of silicon dioxide ($SiO_2$) formed on the upper face of the pressure chamber formation substrate 29 and an insulating film composed of a zirconium oxide ($ZrO_2$) formed on the elastic film. The piezoelectric elements 32 are respectively stacked on regions corresponding to each of the pressure chambers 30, namely, driving regions 35 on the insulating film (the face on the opposite side to the pressure chamber formation substrate 29 side of the diaphragm 31). The piezoelectric elements 32 are formed in two rows along the nozzle row direction so as to correspond to the pressure chambers 30, which are provided in two rows along the nozzle row direction. Note that the pressure chamber formation substrate 29 and the diaphragm 31 stacked thereon correspond to first substrates of the invention.

The piezoelectric elements 32 of the present embodiment are what are known as flexural mode piezoelectric elements. As illustrated in FIG. 3, the piezoelectric elements 32 are, for example, configured by stacking a lower electrode layer 37, a piezoelectric body layer 38, and an upper electrode layer 39 on the diaphragm 31 in that sequence. In the piezoelectric elements 32 configured in this manner, when an electric field is applied between the upper electrode layer 39 and the lower electrode layer 37 according to a potential difference between the two electrodes, the piezoelectric elements 32 undergo flexural deformation in a direction moving away from, or a direction approaching, the nozzles 22. In the present embodiment, each lower electrode layer 37 is an individual electrode independently formed for each piezoelectric element 32, and the upper electrode layer 39 is a common electrode formed so as to span continuously across plural of the piezoelectric elements 32. Namely, a lower electrode layer 37 and a piezoelectric body layer 38 are formed for each pressure chamber 30. In contrast thereto, the upper electrode layer 39 is formed spanning plural of the pressure chambers 30. Note that the lower electrode layers (namely, the electrode layer of the lower layer) may be configured as the common electrode, and the upper electrode layers (namely, electrode layers of the upper layer) may be configured as the individual electrodes depending on the particular driving circuitry or wiring.

As illustrated in FIG. 3, an end portion of each lower electrode layer 37 at one side (an outer side of the pressure chamber formation substrate 29) is provided extending from a region configuring the respective piezoelectric element 32 (namely, the region where the piezoelectric body layer 38 and the upper electrode layer 39 overlap) toward the outside (the end portion side of the pressure chamber formation substrate 29) along a direction orthogonal to the nozzle row direction, and is connected to an individual terminal 41 (corresponding to an electrode of the invention) configured from a metal layer 44. A bump electrode 40 (corresponding to an electrode terminal of the invention), described below, is connected to each individual terminal 41. Note that details relating to the configuration of the lower electrode layers 37, the individual terminals 41, the bump electrodes 40, and so on are given below. An end portion of the upper electrode layer 39 at another side (an inner side of the pressure chamber formation substrate 29), is provided extending from the region configuring the piezoelectric elements 32 to the non-driving region 36 between the rows of the piezoelectric elements 32. In the present embodiment, the upper electrode layer 39 provided extending from the row of piezoelectric elements 32 at the one side, and the upper electrode layer 39 provided extending from the row of piezoelectric elements 32 at the other side, are connected together at the non-driving region 36 between the rows of the piezoelectric elements 32 (not illustrated in the drawings). Namely, a common upper electrode layer 39 is formed to the piezoelectric elements 32 on both sides of the non-driving region 36 between the rows of the piezoelectric elements 32. As illustrated in FIG. 2, common terminals 42 configured from the metal layers 44 are stacked on the upper electrode layer 39, and the upper electrode layer 39 is connected to bump electrodes 40 through the common terminals 42.

Note that, as illustrated in FIG. 3, the metal layers 44 are stacked on both length direction (a direction orthogonal to the nozzle row direction) end portions of the piezoelectric elements 32. Specifically, the metal layers 44 are stacked on the upper electrode layer 39 so as to straddle the boundary between the driving regions 35 and the non-driving regions 36. Excessive deformation at both end portions of the piezoelectric elements 32 can thereby be suppressed, and damage to the piezoelectric body layer 38 or the like at the boundary between the driving regions 35 and the non-driving regions 36 can be suppressed. Note that various metals, such as iridium (Ir), platinum (Pt), titanium (Ti), tungsten (W), nickel (Ni), palladium (Pd), and gold (Au), alloys of these metals, and alloys such as $LaNiO_3$, or the like, may be employed as the lower electrode layers 37 and the upper electrode layer 39 described above. A ferroelectric and piezoelectric material such as lead zirconate titanate (PZT), a relaxor ferroelectric having a metal additive such as niobium (Nb), nickel (Ni), magnesium (Mg), bismuth (Bi), or yttrium (Y), or the like may be employed as the piezoelectric body layer 38. A non-ferrous material such as barium titanate may also be employed. Moreover, a member in which gold (Au), copper (Cu), or the like has been stacked on an adhesion layer configured from titanium (Ti), nickel (Ni), chromium (Cr), tungsten (W), an alloy of these metals, or the like, may be employed as the metal layers 44.

As illustrated in FIG. 2 and FIG. 3, the sealing plate 33 (corresponding to a second substrate of the invention), is a flat plate shaped silicon substrate that is disposed spaced apart from the piezoelectric elements 32 in a state in which an insulating adhesive 43 (corresponding to an insulator of the invention) is interposed between the sealing plate 33 and the diaphragm 31. In the present embodiment, the sealing plate 33 is manufactured from a monocrystalline silicon substrate with surfaces (an upper face and a lower face) having the crystal plane orientation of that of a (110) plane. Plural bump electrodes 40 that output drive signals from the driving IC 34 to the piezoelectric elements 32 side are formed at the lower face (the face on the pressure chamber formation substrate 29 side) of the sealing plate 33 of the present embodiment. As illustrated in FIG. 2, the plural bump electrodes 40 are respectively formed along the nozzle row direction, at positions corresponding to ones of the individual terminals 41 formed to the outside of one of the piezoelectric elements 32, at positions corresponding to others of the individual terminals 41 formed to the outside of others of the piezoelectric elements 32, and at a positions corresponding to the common terminals 42 formed between the two rows of the piezoelectric elements 32. Each of the bump electrodes 40 is connected to the respectively corresponding lower electrode layer 37 or the upper electrode layer 39.

Note that in the present embodiment, a photosensitive adhesive is employed as the adhesive 43 that adheres (bonds) the sealing plate 33 and the pressure chamber formation substrate 29 together. For example, a resin having an epoxy resin, an acrylic resin, a phenol resin, a polyimide resin, a silicone resin, a styrene resin, or the like as its primary component may be suitably employed as the adhesive 43. The adhesive 43 adheres the pressure chamber formation substrate 29, upon which the diaphragm 31 and the like are stacked, and the sealing plate 33 together in a state in which the pressure chamber formation substrate 29 and the sealing plate 33 are spaced apart. Part of the adhesive 43 in the present embodiment is formed enclosing the plural piezoelectric elements 32. Namely, the piezoelectric elements 32 are sealed off within a space enclosed by the pressure chamber formation substrate 29, the sealing plate 33, and the adhesive 43.

The bump electrodes 40 of the present embodiment have elastic properties and project from the surface of the sealing plate 33 toward the diaphragm 31 side. Specifically, as illustrated in FIG. 3, the bump electrodes 40 each include elastic internal resin 40*a* and a conductive film 40*b* configured by a lower face side wiring line 47 covering the surface of at least part of the internal resin 40*a*. The internal resins 40*a* are formed along the nozzle row direction projecting out from the surface of the sealing plate 33. Plural of the conductive films 40*b*, which have electrical continuity with the lower electrode layers 37 (individual terminals 41), are formed along the nozzle row direction so as to correspond to the piezoelectric elements 32 provided in rows along the nozzle row direction. The conductive films 40*b* respectively extend from over the internal resins 40*a* to either one of the piezoelectric elements 32 side or the side opposite to the piezoelectric elements 32 side so as to form the lower face side wiring lines 47. Each end portion of the lower face side wiring lines 47 on the opposite side to the bump electrodes 40 is connected to a penetrating wiring line 45. Note that, an elastic resin configured from a polyimide resin, a phenol resin, an epoxy resin, or the like, may be employed as the internal resins 40*a*. A metal configured from gold (Au), titanium (Ti), aluminum (Al), chromium (Cr), nickel (Ni), copper (Cu), or alloys of these metals, for example, may be employed as the conductive films 40*b*.

The penetrating wiring lines 45 are wiring lines relaying between the lower face and the upper face of the sealing plate 33, and are configured from a conductor such as metal formed inside penetrating holes that penetrate the sealing plate 33 in its thickness direction. Exposed lower face side portions of the penetrating wiring lines 45 are covered by the corresponding lower face side wiring lines 47. Exposed upper face side portions of the penetrating wiring lines 45 are covered by the corresponding upper face side wiring lines 46. The upper face side wiring lines 46 extend from the penetrating wiring lines 45 to an IC connection terminals 50 connected to IC terminals 51 of the driving IC 34, and connect the penetrating wiring lines 45 and the IC connection terminals 50 together. Namely, the IC connection terminals 50 and the bump electrodes 40 are connected by a series of wiring configured from the upper face side wiring lines 46, the penetrating wiring lines 45, and the lower face side wiring lines 47. Note that details relating to the configuration of the wiring from the bump electrodes 40 connected to the individual terminals 41 to the corresponding IC connection terminals 50 are given below.

The driving IC 34 is an IC chip for driving the piezoelectric elements 32, and is stacked on the upper face of the sealing plate 33 with an adhesive 54 such as an anisotropic conductive film (ACF) interposed therebetween. As illustrated in FIG. 2, plural of the IC terminals 51 where the IC connection terminals 50 are connected are formed at the lower face (the face on the sealing plate 33 side) of the driving IC 34. From out of the IC terminals 51, the plural IC terminals 51 corresponding to the individual terminals 41 are provided in rows in the nozzle row direction. In the present embodiment, the IC terminals 51 are formed in two rows so as to correspond to the row of the piezoelectric elements 32, which are provided in two rows. Note that, the array pitch of the IC terminals 51 in the rows of the IC terminals 51 (namely, the distance between centers of adjacent IC terminals 51) is formed smaller than the array pitch of the piezoelectric elements 32.

The recording head 3 formed as described above introduces ink from the ink cartridge 7 to the pressure chambers 30 through the liquid introduction paths 18, the common liquid chambers 25, the individual communication paths 26, and the like. In this state, when drive signals from the driving IC 34 are supplied to the piezoelectric elements 32 through the bump electrodes 40 and so on, the piezoelectric elements 32 are driven and pressure fluctuations arise in the ink inside the pressure chambers 30. These pressure fluctuations are utilized such that the recording head 3 ejects ink from the nozzles 22.

Figure 4:
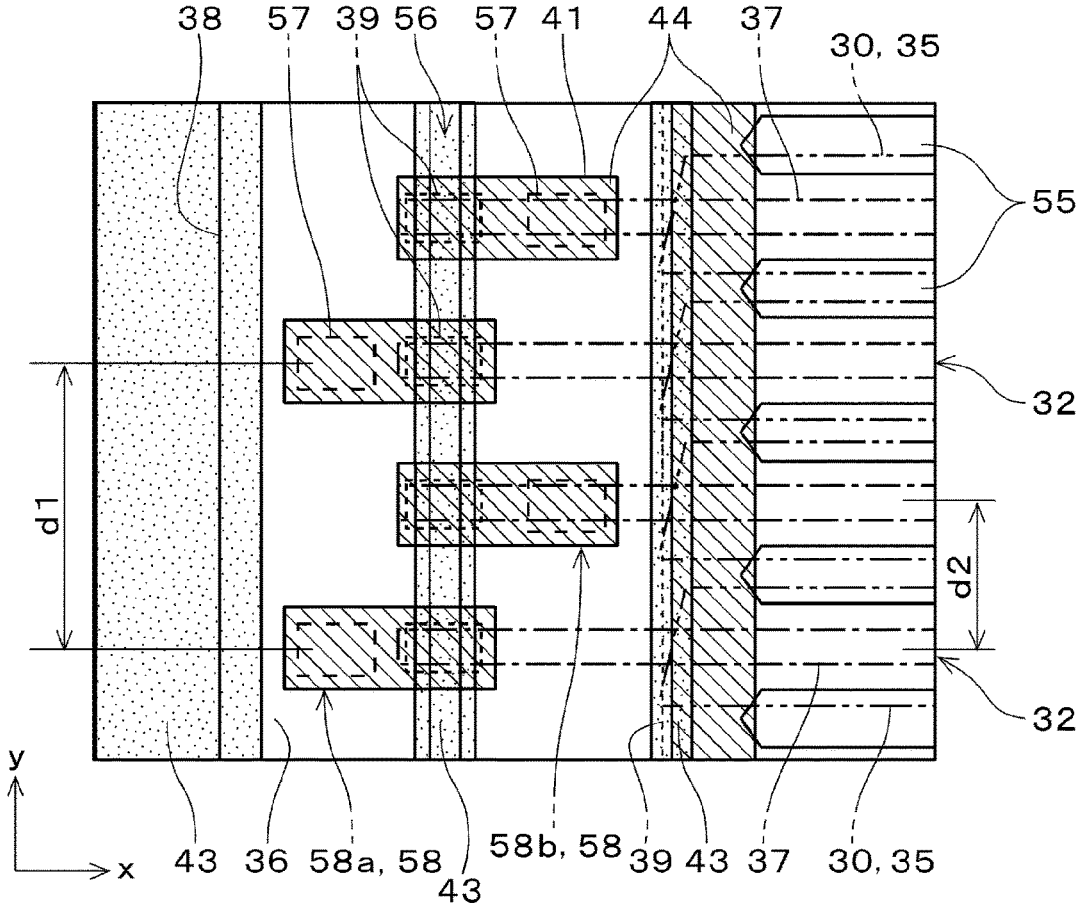
FIG. 4 is an enlarged plan view of portions of a pressure chamber formation substrate.
Figure 5:
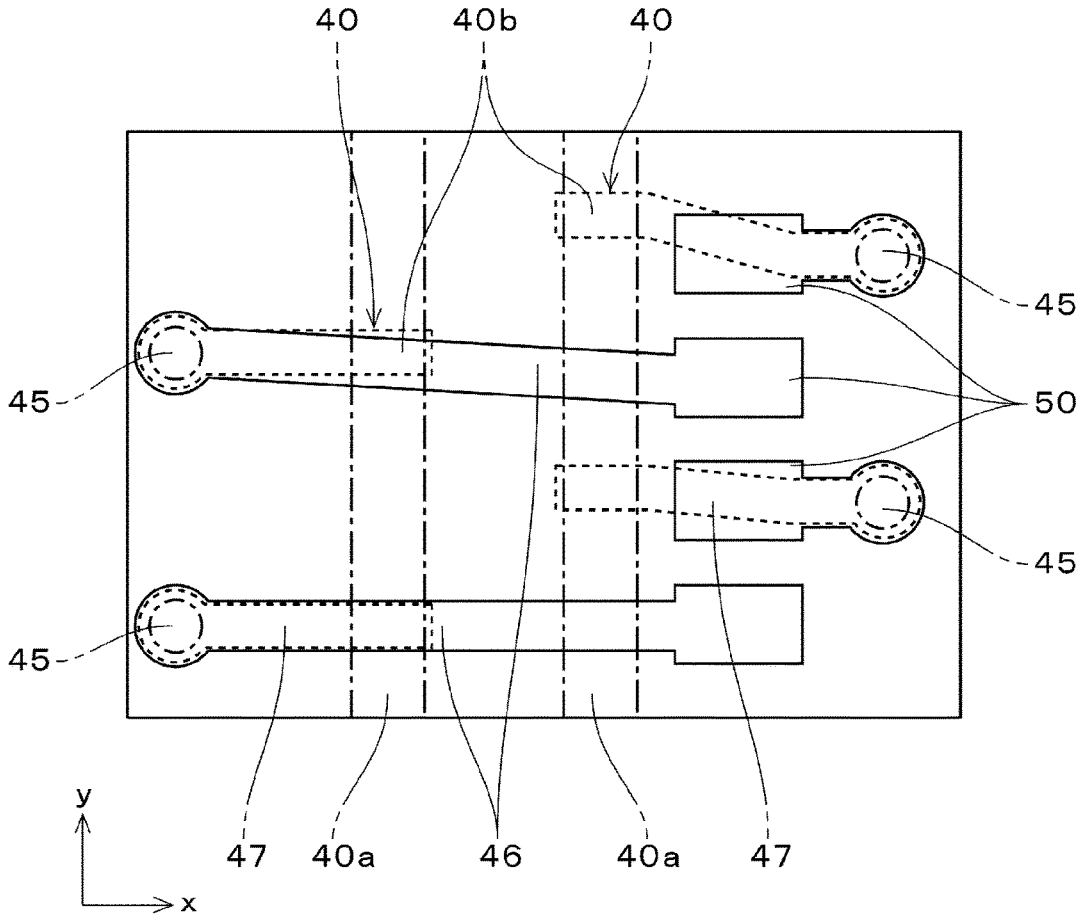
FIG. 5 is an enlarged plan view of portions of a sealing plate.

Next, detailed explanation is given regarding configuration of the lower electrode layers 37, the individual terminals 41, the bump electrodes 40, and the like. FIG. 4 is a plan view of the pressure chamber formation substrate 29 as viewed from above (the sealing plate 33 side). FIG. 5 is a plan view of the sealing plate 33 as viewed from above (the driving IC 34 side). Note that in the following, the direction intersecting the nozzle row direction (orthogonal to, in the present embodiment) is described as a first direction x, and the nozzle row direction is described as a second direction y.

As described above, a lower electrode layer 37 is individually formed for each piezoelectric element 32. As illustrated in FIG. 3 and FIG. 4, each lower electrode layer 37 is provided extending along the first direction x from the driving regions 35 to the non-driving regions 36 at end portion sides of the pressure chamber formation substrate 29. Note that portions of the lower electrode layers 37 that are stacked on the non-driving regions 36 correspond to wiring lines of the invention. As illustrated in FIG. 3 and FIG. 4, the piezoelectric body layer 38 of the present embodiment extend from regions corresponding to the piezoelectric elements 32 (driving regions 35) to the non-driving regions 36 that are further to the outside than the one side end of the lower electrode layer 37 (the opposite side to the piezoelectric elements 32). Note that in the second direction y, both ends of the piezoelectric body layer 38 extend further to the outside than regions where the piezoelectric elements 32 are provided in rows. The non-driving region 36 between the piezoelectric elements 32 forms piezoelectric body openings 55 where the piezoelectric body layer 38 has been removed. Namely, the piezoelectric body layer 38 is divided into the respective piezoelectric elements 32 by the piezoelectric body openings 55.

A region that overlaps with end portions on the one side of the lower electrode layers 37, and that is a region removed from a region where the piezoelectric elements 32 are provided in rows to the outside in the first direction x, forms a contact region 56 where the lower electrode layers 37 are exposed from the piezoelectric body layer 38. Namely, the contact region 56 is a region where the piezoelectric body layer 38 is removed such that no piezoelectric body layer 38 is stacked on the lower electrode layer 37. The contact region 56 of the present embodiment is formed in a slit shape along the second direction y. Plural of the lower electrode layers 37 corresponding to respective piezoelectric elements 32 are exposed at the contact region 56. The upper electrode layer 39 and the metal layers 44 are stacked on the exposed portions of the lower electrode layers 37. The upper electrode layer 39 and the metal layers 44 configure individual terminals 41 individually formed for each lower electrode layer 37. Specifically, as illustrated in FIG. 4, the upper electrode layer 39 forming the individual terminals 41 is formed in a rectangular shape so as to cover the exposed lower electrode layers 37. A dimension of the upper electrode layer 39 in the first direction x is formed larger than a dimension of the contact region 56 in the first direction x. Additionally, a dimension of the upper electrode layer 39 in the second direction y is formed larger than a dimension of the lower electrode layers 37 in the second direction y.

The metal layers 44 forming the individual terminals 41 are formed so as to cover the upper electrode layer 39. As illustrated in FIG. 3 and FIG. 4, each metal layer 44 extends along the first direction x from the region overlapping the upper electrode layer 39 to above at least one piezoelectric body layer 38 out of the piezoelectric body layers 38 formed on both first direction x sides of the contact region 56. Specifically, metal layers 44 that are adjacent in the second direction y extend from the region overlapping the upper electrode layer 39 in opposite directions to each other along the first direction x. The bump electrodes 40 are connected to the metal layers 44 stacked on the piezoelectric body layers 38. Namely, the regions where the bump electrodes 40 are connected form connection regions 57 of the invention. Note that the connection regions 57 are indicated by dashed lines in FIG. 4. As illustrated in FIG. 4, plural of the connection regions 57 are disposed in a zig-zag shape along the second direction y (in a state spaced apart from each other and alternatingly disposed to the left and right on progression along an array direction). Namely, the connection regions 57 corresponding to adjacent piezoelectric elements 32 are disposed having differing positions in the first direction x.

In the present embodiment, a connection region row 58*a* configured from plural of the connection regions 57 aligned in a second direction y in a region on one side (the opposite side to the piezoelectric elements 32) of the contact regions 56 form one row, and a connection region row 58*b* configured from plural of the connection regions 57 aligned in the second direction y in a region on the other side (the piezoelectric elements 32 side) of the contact region 56 form one row. Namely, two rows of the connection region rows 58 are formed. Thus, the number of the connection regions 57 included in one of the connection region rows 58 is half of the number of the piezoelectric elements 32. Accordingly, the array pitch of the connection regions 57 included in one of the connection region rows 58 (namely, a distance d1 between centers of connection regions 57 that are adjacent in the second direction y) is twice the array pitch of the driving regions 35 (namely, a distance d2 between centers of driving regions 35 that are adjacent in the second direction y). In other words, the array pitch of the connection regions 57 included in a connection region row 58 is twice the array pitch of the piezoelectric elements 32, the lower electrode layers 37, or the nozzles 22.

The adhesive 43 that adheres the pressure chamber formation substrate 29 and the sealing plate 33 together is disposed between the connection region row 58*a* on the one side and the connection region row 58*b* on the other side. Namely, the connection region row 58*a* on the one side and the connection region row 58*b* on the other side are separated from each other by the adhesive 43 sandwiched between the pressure chamber formation substrate 29 and the sealing plate 33. In particular, in the present embodiment, as illustrated in FIG. 3 and FIG. 4, the contact region 56, this being a region where the lower electrode layers 37 and the metal layers 44 forming the individual terminals 41 are connected together, is covered by the adhesive 43. More specifically, the adhesive 43 covering the contact region 56 extends along the second direction y further to the outside than the contact region 56. Additionally, a dimension of the adhesive 43 in the first direction x is formed larger than a dimension of the contact region 56 in the first direction x. Note that the adhesive 43 is disposed at both the outside of the connection region rows 58*a* on the one side (the opposite side to the piezoelectric elements 32) and the inside of the connection region rows 58*b* on the other side (the piezoelectric elements 32 side). As illustrated in FIG. 3 and FIG. 4, the adhesive 43 disposed at the outside of the connection region row 58*a* on the one side extends along the first direction x from a position overlapping an end portion on the one side of the piezoelectric body layers 38 to an end portion of the pressure chamber formation substrate 29. The adhesive 43 disposed at the outside of the connection region rows 58*a* on the one side is an adhesive that adheres to the outer periphery of the pressure chamber formation substrate 29. The adhesive 43 disposed at the inside of the connection region rows 58*b* on the other side extends along the first direction x from a position overlapping an end portion on the one side of the pressure chambers 30 (driving regions 35) to the non-driving region 36 between the pressure chambers 30 and the connection region rows 58 on the other side. Both of the adhesives 43 extend along the second direction y.

Shorting between the individual terminals 41 arising from electrical discharge, migration, or the like between the individual terminals 41 is thereby suppressed due to the distance d1 between centers of connection regions 57 that are adjacent in the second direction y being longer than the distance d2 between centers of driving regions 35 that are adjacent in the second direction y. Namely, as the distance between the connection regions 57 is lengthened, the strength of the electric field between connection regions 57 can be reduced, and the likelihood of shorting is reduced, even when a potential difference has arisen between connection regions 57. As a result, the reliability of the recording head 3 is improved. Moreover, as the array pitch of the piezoelectric elements 32 can be reduced, the nozzles 22 can be disposed at a higher density. This enables a recording head 3 compatible with higher image quality to be manufactured. Moreover, since the connection region rows 58 are disposed in two rows having differing positions in the first direction x, the arrangement of the individual terminals 41 is simplified. Moreover, since the adhesive 43 is disposed between the connection region rows 58, shorting between electrodes resulting from electrical discharge, migration, or the like between the electrodes is suppressed between the connection region rows 58. In other words, shorting between electrodes resulting from electrical discharge, migration, or the like between the electrodes is suppressed between the connection regions 57 corresponding to adjacent piezoelectric elements 32. Namely, the adhesive 43 enables the conductivity between connection regions 57 corresponding to adjacent piezoelectric elements 32 to be increased and enables the strength of the electric field between the connection regions 57 to be reduced. In the present embodiment, shorting between electrodes resulting from electrical discharge, migration, or the like between the electrodes is suppressed in the contact region 56 due to the contact region 56 being covered by the adhesive 43. Accordingly, as there is no need to dispose the contact region 56 in a zig-zag (with plural provided spaced apart from each other in alternating rows to the left and right) such as for the connection regions 57, the configuration is simplified even further. Moreover, as distances from the driving regions 35 of the lower electrode layers 37 to the contact region 56 can be made uniform, namely, as the wiring length can be made uniform, the voltage response characteristics of the piezoelectric elements 32 can be made uniform.

In accordance with the connection regions 57 disposed in a zig-zag, the bump electrodes 40 of the sealing plate 33 connected to the individual terminals 41 are also disposed in a zig-zag. Specifically, as illustrated in FIG. 5, internal resins 40*a* are respectively formed along the second direction y at positions corresponding to the connection region row 58 on the one side and at positions corresponding to the connection region row 58 on the other side. The conductive films 40*b* are disposed in a zig-zag in accordance with the connection regions 57. Namely, the conductive films 40*b* corresponding to adjacent IC connection terminals 50 are separated into that for an internal resin 40*a* at the one side and an internal resin 40*a* at the other side, and respectively stacked thereon. The bump electrodes 40 corresponding to adjacent IC connection terminals 50 are thereby disposed at differing positions in the first direction x.

Note that as the array pitch of the IC connection terminals 50 (namely, the array pitch of the IC terminals 51) of the present embodiment is formed smaller than the array pitch of the piezoelectric elements 32 (namely, half of the array pitch of the connection regions 57), pitch conversion is carried out by wiring (the upper face side wiring lines 46 or the lower face side wiring lines 47) that links together the IC connection terminals 50 and the bump electrodes 40. Specifically, the lower face side wiring lines 47 forming the conductive films 40*b* stacked on the internal resins 40*a* on the one side (the left side in FIG. 5) extends along the first direction x to the penetrating wiring lines 45 formed further to the outside (the opposite side to the piezoelectric elements 32) than the internal resins 40*a*. The upper face side wiring lines 46 extending from the penetrating wiring lines 45 extend to the IC connection terminals 50 with an inclination angle in accordance with this position. In contrast thereto, the lower face side wiring lines 47 forming the conductive films 40*b* stacked on the internal resins 40*a* at the other side extend to the penetrating wiring lines 45 formed further to the inside (the piezoelectric elements 32 side) than the internal resin 40*a*, with an inclination angle in accordance with the positions thereof. The upper face side wiring lines 46 extending from the penetrating wiring lines 45 extend along the first direction x to the IC connection terminals 50. Performing pitch conversion in such a manner enables the array pitch of the IC terminals 51 to be shortened, consequently enabling the driving IC 34 to be made more compact.

Although two rows of the connection region rows 58 are formed in the first embodiment above, and the array pitch of the connection regions 57' included in one of the connection region rows 58 is formed at twice the array pitch of the driving regions 35, there is no limitation thereto. For example, in a second embodiment illustrated in FIG. 6, three rows of connection region rows 58' are formed, and the array pitch of connection regions 57' included in one of the connection region rows 58' is formed at three times the array pitch of the driving regions 35.

Specifically, contact regions 56' of the present embodiment are formed in two rows having differing positions in the first direction x, in the non-driving regions 36 set off to the outside of the driving regions 35 along the first direction x. Namely, a contact region 56' is formed in one row to the outside in the first direction x (the opposite side to the piezoelectric elements 32), and a contact regions 56' is formed in one row to the inside in the first direction x (the piezoelectric elements 32 side). End portions on one side of lower electrode layers 37' extend to either one of the contact regions 56', and are exposed from between piezoelectric body layers 38'. In the present embodiment, one of the lower electrode layers 37' extending to the outside contact region 56' and two lower electrode layers 37' extending to the inside contact region 56' are alternatingly formed in rows in the second direction y. In other words, every third member is a lower electrode layer 37' disposed extending to the outside contact region 56'. The upper electrode layer 39' and the metal layers 44' are stacked on portions that are exposed from between the piezoelectric body layers 38' at end portions of the lower electrode layers 37'. Note that the lower electrode layers 37' extending to the outside contact region 56' straddle the inside contact region 56', and so portions of the lower electrode layers 37' partway along the extension direction thereof are exposed from between the piezoelectric body layers 38'. The upper electrode layer 39' is stacked on the portions of the lower electrode layers 37' exposed to the inside contact region 56' such that the lower electrode layers 37' are protected from over etching.

Figure 6:
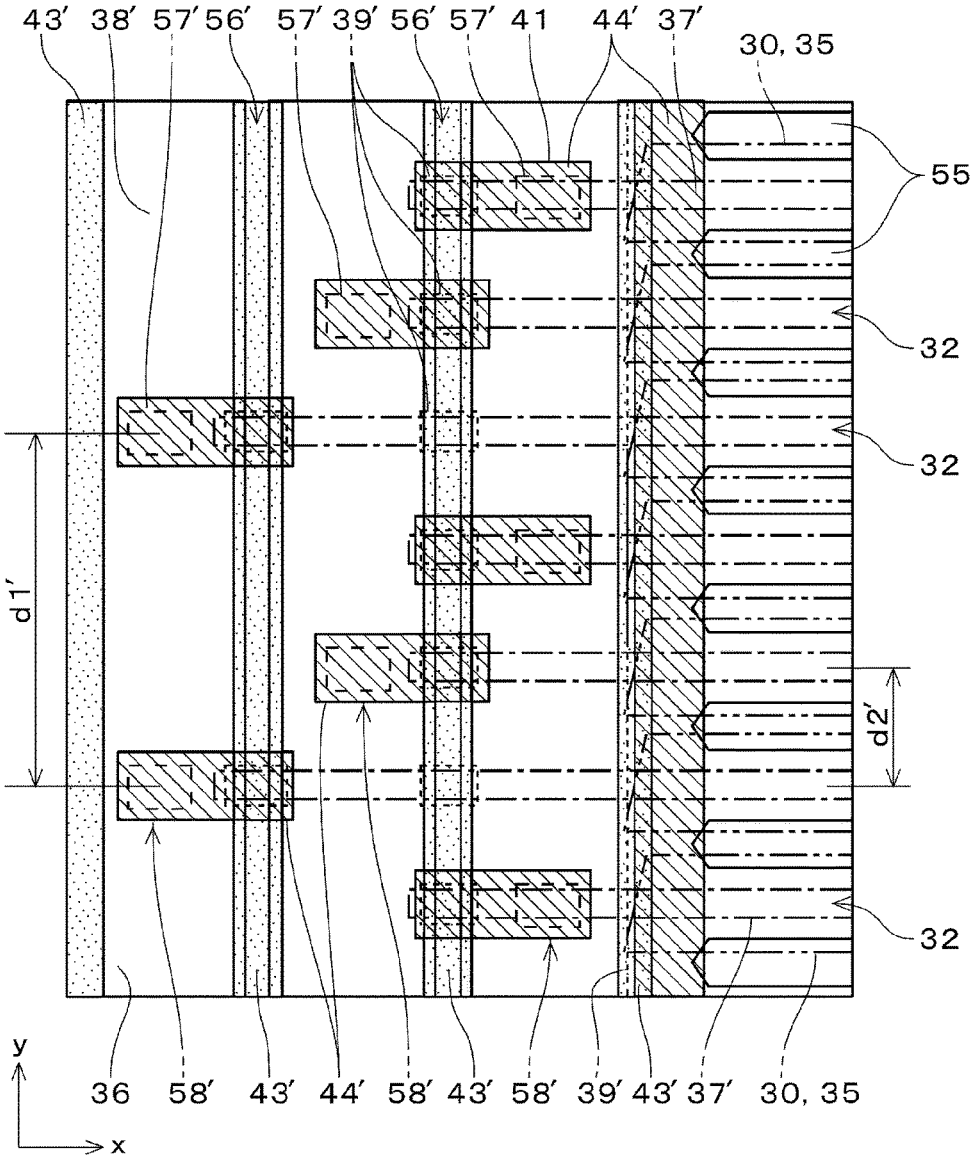
FIG. 6 is an enlarged plan view of portions of a pressure chamber formation substrate of a second embodiment.

Similarly to the first embodiment, the upper electrode layer 39' formed on the contact regions 56' is formed in a rectangular shape so as to cover the exposed lower electrode layers 37'. The metal layers 44' forming the individual terminals 41' are formed so as to cover the upper electrode layer 39' stacked on the end portions of the lower electrode layers 37'. As illustrated in FIG. 6, the metal layers 44' extend from a region overlapping the upper electrode layer 39' to one of three regions separated in the first direction x by the two contact regions 56' rows. Specifically, the metal layers 44' stacked on the inside contact region 56' extend to the region between the inside contact region 56' and the outside contact region 56', or to the region between the inside contact region 56' and the driving regions 35. Similarly to the first embodiment, the metal layers 44' stacked on the inside contact region 56' that are adjacent in the second direction y extend from the region overlapping the upper electrode layer 39' in opposite directions to each other along the first direction x. The metal layers 44' stacked on the outside contact region 56' extend to a region further to the outside than the outside contact region 56'. Bump electrodes are connected to the metal layers 44' extending to these regions. Namely, connection regions 57' connected to the bump electrodes are formed to extension portions of the metal layers 44'. Note that the connection regions 57' are represented by a dashed line in FIG. 6.

By disposing the metal layers 44' as described above, the connection regions 57' corresponding to adjacent piezoelectric elements 32 are disposed with differing positions in the first direction x in the present embodiment. Specifically, connection region rows 58' forming the plural connection regions 57' having positions aligned in the second direction y are respectively formed to the region further to the outside than the outside contact region 56', to the region between the inside contact region 56' and the outside contact region 56', and to the region between the inside contact region 56' and the driving regions 35. As the connection region rows 58' are thus formed in three rows, the array pitch of the connection regions 57' included in one of the connection region rows 58' (namely, a distance d1' between centers of connection regions 57' that are adjacent in the second direction y) is three times the array pitch of the driving regions 35 (namely, a distance d2' between centers of driving regions 35 that are adjacent in the second direction y). In other words, the array pitch of the connection regions 57' included in the connection region rows 58' is three times the array pitch of the piezoelectric elements 32, the lower electrode layers 37', or the nozzles 22. In the present embodiment, the adhesive 43' is disposed so as to cover each of the contact regions 56'. The respective regions where the connection region rows 58' are disposed are separated from each other by the adhesive 43'. Namely, the connection region rows 58' are respectively separated by the adhesive 43'. Note that although not illustrated in the drawings, the bump electrodes are arranged similarly to the connection regions. Namely, the internal resins are formed in three rows so as to correspond to the connection region rows 58', and a conductive film is stacked on the internal resins at positions corresponding to the respective connection regions. As the wiring from the bump electrodes to the IC connection terminals can be designed as appropriate, explanation thereof is omitted. Other configuration is substantially the same as the above embodiment, and so explanation thereof is also omitted.

Note that the connection region rows are not limited to being two rows or three rows, and the connection regions can be provided with plural additional rows. The array pitch of the connection region can also be further increased in accordance with the number of connection region rows. Additionally, the extension direction of the lower electrode layers 37 and the extension direction of the connection region rows 58 (the array direction of the connection regions 57), may be non-orthogonal. Namely, the relationship between the first direction x and the second direction y is not limited to being orthogonal. Although an example has been given above in which the bump electrodes 40 including internal resins 40*a* serve as electrode terminals connected to the connection regions 57, there is no limitation thereto. Metal bump electrodes or the like configured solely from metal that does not include resin internally can be adopted. Moreover, although an example has been given of configuration in which the sealing plate 33 is provided with the driving IC 34, wiring (the penetrating wiring lines 45, the upper face side wiring lines 46, the lower face side wiring lines 47, and the like), electrode terminals (the bump electrodes 40), and the like, and the bump electrodes 40 are connected to the connection regions 57, there is no limitation thereto. Configuration can be adopted in which a wiring substrate such as a flexible printed circuit (FPC) including a driving IC is provided separately from a sealing plate, and electrode terminals of the wiring substrate connect to a connection region. Additionally, the contact region is not limited to a slit shape formed spanning plural individual terminals, and may be formed for each individual terminal.

Moreover, although an example has been given above in which what are known as flexural oscillation type piezoelectric elements 32 serve as actuators for driving the driving regions 35, there is no limitation thereto. For example, various actuators such as what is known as a longitudinal oscillation type piezoelectric elements, heating elements, electrostatic actuators that use electrostatic force to vary the capacity of pressure chambers, can be adopted. Moreover, although an example has been given of configuration in which the driving regions 35, these being one type of movable regions, are displaced by driving the piezoelectric elements 32 such that ink, this being one type of liquid, is ejected from the nozzles 22, there is no limitation thereto. The invention can be applied to any MEMS device that includes a movable region and wiring extending from the movable region. For example, the invention can be applied to sensors that detect pressure changes, vibration, displacement, or the like in movable regions.

Although explanation has been given above regarding an example in which an ink jet recording head 3 serves as a liquid ejecting head, the invention can be applied to other liquid ejecting heads that include pressure chambers bounded by movable regions (driving regions). For example, the invention can be applied to colorant ejecting heads employed in the manufacture of color filters for liquid crystal displays or the like, electrode material ejecting heads employed to form electrodes of organic electroluminescent (EL) displays, field emission displays (FEDs), or the like, bioorganic matter ejecting heads employed in the manufacture of biochips (biochemical elements), and the like. In colorant ejecting heads for display manufacturing apparatuses, solutions of R (red), G (green), and B (blue) colors are each ejected as respective types of liquid. In electrode material ejecting heads for electrode forming apparatuses, a liquid electrode material is ejected as one type of liquid, and in bioorganic matter ejecting heads for chip manufacturing apparatuses, a bioorganic matter solution is ejected as one type of liquid.

What is claimed is:

1. A MEMS device, comprising:

a plurality of movable regions;

wiring lines extending along a first direction from the movable regions, the wiring lines being electrodes of a plurality of piezoelectric elements that displace the movable regions; and electrodes connected to the wiring lines, the electrodes including connection regions for connecting other electrode terminals thereto, a plurality of the connection regions being disposed along a second direction intersecting the first direction, and a distance between centers of ones of the connection regions that are adjacent in the second direction being longer than a distance between centers of ones of the movable regions that are adjacent in the second direction.

2. The MEMS device according to claim 1, wherein:

a plurality of connection region rows, respectively configured from a plurality of the connection regions having positions aligned in the second direction, are provided at differing positions in the first direction.

3. The MEMS device according to claim 2, wherein:

the movable regions, the wiring lines, and the electrodes are provided to a first substrate; and an insulator sandwiched between the first substrate and a second substrate provided with the other electrode terminals is formed between ones of the connection region rows that are adjacent in the first direction on the first substrate.

4. The MEMS device according to claim 3, wherein:

a contact region where the wiring lines and the electrodes are connected together is covered by the insulator.

5. A liquid ejecting head comprising the MEMS device according to claim 4, wherein:

the MEMS device includes pressure chambers that have at least a portion bounded by the movable regions, and nozzles that are in communication with the pressure chambers; and the electrodes are individual terminals that transmit a drive signal to the piezoelectric element through the wiring lines.

6. A liquid ejecting head comprising the MEMS device according to claim 3, wherein:

the MEMS device includes pressure chambers that have at least a portion bounded by the movable regions, and nozzles that are in communication with the pressure chambers; and the electrodes are individual terminals that transmit a drive signal to the piezoelectric element through the wiring lines.

7. A liquid ejecting head comprising the MEMS device according to claim 2, wherein:

the MEMS device includes pressure chambers that have at least a portion bounded by the movable regions, and nozzles that are in communication with the pressure chambers; and the electrodes are individual terminals that transmit a drive signal to the piezoelectric element through the wiring lines.

8. The MEMS device according to claim 1, wherein:

the distance between centers of ones of the connection regions that are adjacent in the second direction is at least twice the distance between centers of ones of the movable regions that are adjacent in the second direction.

9. A liquid ejecting head comprising the MEMS device according to claim 8, wherein:

the MEMS device includes pressure chambers that have at least a portion bounded by the movable regions, and nozzles that are in communication with the pressure chambers; and the electrodes are individual terminals that transmit a drive signal to the piezoelectric element through the wiring lines.

10. A liquid ejecting head comprising the MEMS device according to claim 1, wherein:

the MEMS device includes pressure chambers that have at least a portion bounded by the movable regions, and nozzles that are in communication with the pressure chambers; and the electrodes are individual terminals that transmit a drive signal to the piezoelectric elements through the wiring lines.

* * * * *